US009053643B2

(12) United States Patent
Paavilainen

(10) Patent No.: US 9,053,643 B2
(45) Date of Patent: Jun. 9, 2015

(54) SEALING SYSTEM FOR SEALING OF DOORS OF TRANSPORT VEHICLES

(75) Inventor: Samuli Paavilainen, Turku (FI)

(73) Assignee: Deutsche Post AG, Bonn (DE)

( * ) Notice: Subject to any disclaimer, the term of this patent is extended or adjusted under 35 U.S.C. 154(b) by 117 days.

(21) Appl. No.: 13/636,104

(22) PCT Filed: Mar. 23, 2011

(86) PCT No.: PCT/EP2011/001432

§ 371 (c)(1),
(2), (4) Date: Sep. 19, 2012

(87) PCT Pub. No.: WO2011/120649

PCT Pub. Date: Oct. 6, 2011

(65) Prior Publication Data

US 2013/0044007 A1 Feb. 21, 2013

(30) Foreign Application Priority Data

Mar. 29, 2010 (EP) ..... 10158198

(51) Int. Cl.
*G08B 13/08* (2006.01)
*G09F 3/03* (2006.01)
*G09F 3/00* (2006.01)

(52) U.S. Cl.
CPC ..... *G09F 3/03* (2013.01); *G09F 3/0292* (2013.01)

(58) Field of Classification Search
CPC ..... G08B 13/08
USPC ..... 340/945, 571, 572.1, 572.8, 572.9, 340/545.1
See application file for complete search history.

(56) References Cited

U.S. PATENT DOCUMENTS

| | | | | |
|---|---|---|---|---|
| 6,034,603 | A * | 3/2000 | Steeves | 340/10.2 |
| 2004/0227632 | A1 | 11/2004 | Grijalva et al. | |
| 2006/0208859 | A1 * | 9/2006 | Hougen et al. | 340/10.1 |
| 2006/0214789 | A1 * | 9/2006 | Posamentier et al. | 340/545.6 |
| 2007/0046467 | A1 * | 3/2007 | Chakraborty et al. | 340/572.1 |
| 2007/0120381 | A1 * | 5/2007 | Ehrensvard et al. | 292/307 R |
| 2010/0182138 | A1 | 7/2010 | Schofield | |

FOREIGN PATENT DOCUMENTS

| | | | |
|---|---|---|---|
| GB | 2446178 A | 8/2008 | |
| WO | WO 2007088045 A1 * | 8/2007 | E05B 39/04 |

OTHER PUBLICATIONS

International Search Report, dated Jun. 24, 2011 (English).

* cited by examiner

*Primary Examiner* — Hai Phan
*Assistant Examiner* — Zhen Y Wu
(74) *Attorney, Agent, or Firm* — International IP Law Group, PLLC

(57) ABSTRACT

Described herein is a seal, having a tape-like shape, for doors of transport vehicles, attachable to the doors to indicate closure. The door includes a first area to be positioned onto the door and a second area to be positioned onto an area-around the door. The seal also includes an indicator suitable to be activated after attaching the seal to the transport vehicle—and suitable to send-out a warning signal-in case the seal is detached or damaged after activation of the indicator. A portable logging device for sealing doors of transport vehicles includes a data insert unit to insert a specific type of transport vehicle and to insert the executed attachment of a seal to a certain door, to record sealing the door.

18 Claims, 4 Drawing Sheets

SEALING SYSTEM FOR SEALING OF DOORS OF TRANSPORT VEHICLES

CROSS-REFERENCE TO RELATED APPLICATIONS

Pursuant to 35 U.S.C. §371, this application is the United States National Stage Application of International Patent Application No. PCT/EP2011/001432, filed on Mar. 23, 2011, the contents of which are incorporated by reference as if set forth in their entirety herein, which claims priority to European (EP) Patent Application No. 10158198.1, filed Mar. 29, 2010, the contents of which are incorporated by reference as if set forth in their entirety herein.

BACKGROUND

The doors of a transport vehicle are often sealed after closure of the doors during a checking procedure (clearance) with a seal applied to each of the doors. The seals provide visual indicators that the doors are closed at a certain point of time and not have been opened later on. In logistic centers, seals may be applied to doors of trucks, train wagons etc. to provide a visible sign to the receiving center, that the transport vehicle (at least the storage volume for the transported freight) is not opened during transport, in case of unbroken seals. The seals prevent non-authorized opening of doors to secure the freight loaded to the transport vehicle. Additionally, or in the alternative,—the sealing procedure is part of a release procedure, in the case of transports with security standards. As an example, aircrafts are released to be allowed to leave the airport. Open doors during take-off and during the flight are a severe safety problem. Therefore, all doors of the aircraft are closed and checked before releasing the aircraft for taking-off (clearance). Typically, one or more airport employees visually check all doors of each aircraft and attach an adhesive tape across each closed door at the outer side. The adhesive tape provides a visual indicator that the particular door is checked and closed. In parallel, the airport employee fills out a paper check list to record in writing the executed check procedure. After completing the check procedure, the paper check lists are archived. The airport provides an adapted check list per aircraft type, since the number and the location of doors differs between different aircraft types, which involves costly administrative effort. Furthermore, because the checking procedure does not support finding doors, to find the location of all doors can be difficult for some aircraft types. Additionally, already checked doors with attached tape might be opened later. Such re-opened doors may stay open unnoticed. The checking procedure is time-consuming. Eventual doubts about the correct execution of the check procedure involve a repeated second check procedure leading to time delays in the clearance of aircrafts for subsequent take-off. The listed disadvantages also apply to other transport vehicles.

SUMMARY

The subject innovation relates to a sealing system for sealing doors of transport vehicles, a seal and a portable logging device used by the system, and a method to operate such a system.

The seal according to the subject innovation provides a visual indicator that the particular door is checked and closed. Additionally, any re-opening of the door is detected by measuring at least one characteristic parameter, where a specified value indicates either the closed status of the door or the non-authorized re-opening of the door. Therefore, the seal according to the recent invention improves the security of the transported freight and the transport vehicle. In case of re-opened doors, the freight of the transport vehicle can be checked again to detect any burglary, and additionally, security risks to operate the transport vehicle can be avoided. Furthermore, whether a door might be re-opened or not, the seal provides a secure prove of the history that happened to the door. If no warning signal is sent-out, there is no re-opening of the door. Therefore, a time-consuming second check can be avoided, preventing time delays in the clearance of transport vehicles, e.g. aircraft for subsequent take-off. A seal that is attachable to door and the area around the door may provide ease of use. Using this type of seal, the sealing procedure (attaching the seal to a door) is executed by an operator.

In the context of the subject innovation, transport vehicles denote any transport vehicle or components of the transport vehicles that are suitable for applying the seal. The term, "transport vehicles," includes trucks, cars, train wagons, ships, container for container trucks, and aircraft, such as airplanes, helicopters, etc. The term, "doors," includes any opening that can be closed and re-opened, (e.g., doors of trucks, cars, aircraft, scuttles, portholes, hatchways, tailboards, etc. The term, "attachable," denotes any property of the seal which enables the fixation of the seal at a certain position on the door and on the area around the door, which could be the door frame, the area surrounding the door frame, or the wall to which the door is fixed. The attachable seal might be glued, clamped, or otherwise fixed at a specified position. The term, "indicate the closure," may denote any suitable measure to inform a user that this door is checked, that it is closed, and that the door has not been opened again since checking the door. Any visual inspection shows whether the seal is present and undamaged. Furthermore, the seal might send-out signals providing the status of the seal, e.g., a warning signal in case of a re-opened door. The signals may be visual, audible or detectable electromagnetic high frequency or infrared signals. The term, "onto the door/area around the door," denotes the attachment of the seal to the surface of the door and the area around the door. The surface of the door or area around the door can be the outer surface (e.g., in the case of doors of aircraft), or for other purposes, the inner surface of the wall of a transport vehicle. The area around the door can be the frame of the door or the wall the door is mounted to. In case of a door frame as the area around the door where the seal is attached, the surface can be the inner or outer surface, or the surface of the frame facing the door in a closed status. In some embodiments of doors, there might be no separate frame. In case of double wing doors, the seal might be attached over both wings of the door, where the wing closed first is denoted as the area around the door, while the other door wing (closed later) is denoted as the door. Alternatively, double wing doors might be sealed by applying one seal according to the subject innovation for each wing of the double wing door. In this case, the seal can be applied onto each of the doors and onto the areas around the doors.

The term, "seal," denotes a seal of any shape that can be attached to a door, as listed above. The seal has a tape-like shape with lateral dimensions larger than the thickness of the seal. The advantage of a tape-like seal is the possibility to attach the seal to non-flat areas, e.g., doors, door frames, or door surroundings. The seal may be made of a piece of material, such as rubber, metal, plastic, or combinations thereof with further embedded components. The seal may include a combination of elastic and inelastic materials. The seal may include elastic components or elastic parts of the seal in order to be usable for different kind of doors having different shapes and sizes. The material of the seal may include electrical wires, or electrically conductive layers arranged at the surface of the seal, or close to the surface of the seal, e.g., at the first and second areas of the seal. These wires and/or electrically conductive layers may serve as a sensing component for determining the status of the door (closed or open), e.g., via determining its resistance or capacitance values.

The activation of the seal is the action to start a control procedure of the seal, where the seal recognizes any re-opening of the door. The indicator of the seal can be activated manually via a switch, or automatically as a response of being attached to a surface or via an external signal. The activation starts a continuous or periodic measurement of a certain parameter, where the value of the parameter corresponds to the status of the door (closed or open). In case of re-opening of the door, the sent-out warning signal could be any type of warning signals suitable of being recognized by either a control system, e.g. a computer system, and/or present people. Depending on the embodiment of the seal, the activation of the indication means might be reversible or non-reversible. In case of non-reversible activation, the seals are for one-time use. In one embodiment, the indicator is able to be de-activated by authorized people, which enables re-use. However, seals can also be de-activated by non-authorized persons. This could be achieved by a suitable positioning of the seals, e.g., at the outside of aircraft when the doors can only be re-opened from the inside of the aircraft. However, it is advantageous if the de-activation is only possible for authorized persons, e.g., by a certain mandatory identification procedure that authorized people perform before being able to de-activate the seal.

In another embodiment, the first and second areas are arranged to apply an adhesive and/or magnetic force to the door, and the area around the door to be attached. An adhesive force can be applied to the door and/or the area around the door, if a layer of glue is on top of the first and/or second areas. Alternatively, the first and second areas might be arranged as self-adhesive areas, e.g. as an adhesive tape such as a scotch tape. People skilled in the art may consider other adhesive means arranged on said first and second areas to securely attach the seal to the doors and areas around the doors. The first and/or second areas of the seal can be arranged as a magnet applying a magnetic force to any surface which is metallic as are many transport vehicles. First and/or second areas arranged as a magnet provide a tight fixation of a seal on randomly shaped surfaces of doors and areas around the doors. The advantage of attaching seals by applying adhesive and/or magnetic forces is the easy handling and the possible reversible use of the seals. If a door already sealed is opened by an authorized person, the indicator can be de-activated and the seal removed to be re-used later.

In another embodiment, the seal further comprises an identifier providing a machine-readable code suitable to be read by a portable logging device after attaching the seal at least to the door. Advantageously, this enables logging of the checked doors with applied seals. The operator attaching the seals to the doors does not fill in check lists manually to log the sealing procedure, but instead can log the code of each seal applied to a door using a logging device that reads the seal identifier. The machine-readable code can be any kind of code able to identify the seal, i.e., to distinguish a particular seal from other seals, and to be read by the logging device. The identifier can be a separate component of the seal or can be part of the indicator. For example, the machine-readable code may be a barcode label applied (glued) to the outer surface of the seal (outer surface=surface facing away from the door) or the machine-readable code can be provided as electromagnetic signal sent-out by a RFID chip as part of the indicator inside the seal.

In another embodiment, the indicator includes a control to detect a detaching or damaging of the seal, and to subsequently provide a detection signal, such as, an electronic signal. The control is the unit executing the measurement of a certain parameter, whose value corresponds to the status of the door (closed or open). The seal may be equipped with a conductive layer, which breaks during the re-opening of the door. The change of the electrical properties (e.g., the capacity of this layer) is sensed and a corresponding signal is provided, e.g., a detection signal after detection of the re-opening of the door. Alternatively, the control includes a closed electrical circuit which breaks during re-opening of the door, resulting in a steep increase of the resistance of this closed circuit. The change of the resistance triggers the control to provide the detection signal. The detection signal may be an electrical signal to other components of the indicator. Alternatively, the attaching procedure may close an electrical circuit by providing an electrical contact between two contact pins arranged at the first and/or second areas, which is established through the metal surface of the door and the area surrounding the door. The first and second areas may include two contact pins, each with an electrical contact between the contact pins of the first area established by the conductive surface of the door, and between the contact pins of the second area, establish by the conductive surface of the area around the door. The detection signal is provided when the seal is in an activated status. People skilled in the art may consider alternative control units in order to detect a detaching or damaging of the seal within the scope of subject innovation.

In another embodiment, the indicator includes a sender, such as, a RFID chip, suitable to send out the warning signal as a response to the detection signal provided by the control. The sender may be suitable to send out a warning signal. There are very small and/or flat chips available as senders on the market today suitable to be integrated into a seal, e.g., a tape-like seal. An additional antenna can also be arranged as a flat antenna inside the seal. As an example, RFID transponders (RFID chips) are able to provide signals with a large possible operating distance up to 100 m. The indicator includes an RFID chip that may be activated, e.g., activation of the seal, by receiving an external activation signal, provided by, for example, the portable logging device. The power, e.g., for active RFID tags, to operate the seal may be received from a flat battery embedded in the seal. In one embodiment, the indicator includes a clock to record the time when the detection signal is received. In another embodiment, the warning signal includes the time when the detection signal is provided from the control. The warning signal may have any suitable format to be able to be received from a receiving station, e.g. having a Bluetooth or ZigBee format, comprising the code of the broken seal, preferably together with the time, when the control means detected the break or damage of the seal. People skilled in the art may consider other senders within the scope of this invention. The range of operation depends on transmitting power, frequency and receiver sensitivity.

In another embodiment, the seal further comprises a lighting unit to emit light after activation. The lighting components may be a LED or another electroluminescent light source as part of the seal. A light emitting seal enables a fast check from a longer distance of the present seals of a transport vehicle, especially during night.

In another embodiment, the seal further includes a power source, e.g., a flat battery, to provide power to the lighting unit and/or to the indicator to operate the control unit and/or the sending unit and/or the identification unit.

The subject innovation further relates to a portable logging device for sealing of doors of transport vehicles including a data insert unit to insert a particular type of the transport vehicles and to insert the executed attachment of a seal according to a certain door to record the sealing of the door, and a data unit suitable to store the inserted data. The portable logging device replaces any paper check lists to record the executed sealing procedure. The sealing procedure can be executed faster due to being able to avoid the manual filling of forms. Eventual doubts about the correct execution of the check procedure can be resolved by checking the recorded sealing data, thereby avoiding a time-consuming second check procedure, which lead to time delays in the clearance of transport vehicles, e.g., aircraft for subsequent take-off.

The logging device is portable, e.g., as a hand-held device. The data insert unit can be any suitable array of buttons or keys to insert data, e.g., a keyboard or an array of keys for multiple characters, numbers and/or symbols. The transport vehicles can be different. Even in the same class of transport vehicles, e.g., aircraft, there are many different types of transport vehicles, e.g. small aircraft, large aircraft, aircraft of any size from different manufactures, etc., having a different number and location of doors. After inserting the type of the transport vehicle the portable logging device may provide the number of doors to be checked for this particular transport vehicle. Alternatively, the portable logging device may count the inserted executed attachments and compare the number to the expected number of doors to be checked for this particular type of transport vehicle. The inserted data is stored in a suitable data unit, e.g., a memory chip or a memory card.

In an embodiment where the seal comprises identifier, providing a machine-readable code and the portable logging device further comprises a reading unit to read a machine-readable code of the identification means and to store the machine-readable code in the data unit. The reading unit may be any suitable reading unit adapted to the machine-readable code of the seal. In the case of a barcode as the machine-readable code, the reading unit is a barcode scanner. If the machine-readable code is coded electronically, the reading unit is an adapted receiver of the send-out code of the seal. This machine-readable code together with a portable device able to read the code of the seal reduces the time for the sealing procedure. The operator merely attaches the seal to the door and places the portable logging device for a short moment in a suitable position in front of the sea in order to record the executed sealing for this door, thus reducing the typical amount of time taken to complete the sealing procedures.

In another embodiment, the portable logging device further comprises a display unit for displaying the location of each door of the particular type of the transport vehicles, where the seal is attached, and for correlating the location of the door with the machine-readable code of the identifier of the seal attached to this door. This support for the operator to find the doors provides an advantage because the large number of different types of transport vehicles makes it challenging for the operators executing the sealing procedure to find the doors to be checked. A door that is difficult to find may lead to a delay in the clearance of a transport vehicle. Furthermore, the sealing procedure may be performed with the time-consuming effort of finding all the doors beforehand.

The display unit may be any suitable display of a suitable size to support the operator to find all the doors of the transport vehicle in a short time period. The location of the doors may be display as marker of a displayed lay-out or blueprint of the transport vehicle. The portable device may further include a GPS module in order to provide distance and orientation information to the operators in case of large transport vehicles, such as aircraft, ships, or trains. The combination of marked doors and the distance between the current position of the operator and the next door improves the support to the operator on how to find the next door. The location of the door on the lay-out or blueprint can be correlated to the code of the seal. This correlation decreases the time and effort to check a seal in case of receiving the warning signal from the seal because the location of the particular seal is known.

In another embodiment, the portable logging device includes a data connection unit suitable to transfer the data to a computer system and/or update the data stored in the data unit, e.g., via a wireless data connection. The data connection unit may be a data port suitable to be inserted in a corresponding reading device connected to the computer system. The wireless connection may be provided by a WLAN system present in the environment of the portable device, where the computer system is connected to. The possibility of transmitting the recorded data via a data connection to a computer system makes archiving of sealing data very easy and fast. Eventual doubts about the correct execution of the sealing procedure can be proven by checking the archived sealing data avoiding a time consuming second sealing procedure.

The invention further relates to a sealing system for sealing of doors of transport vehicles comprising multiple seals according to the present invention, at least one portable logging device according to the present invention and a clearance system comprising a computer system for receiving and storing data from the portable logging device, suitable to receive the warning signal from the seal and to provide an alarm signal at least inside a clearance area as a response of the received warning signal. The clearance system denotes the system for releasing the transport vehicle to transport the freight to the desired destination. The freight includes goods of any kind and/or people transported by the transport vehicle. For example, using an aircraft as the transport vehicle, the clearance system includes the steps and components for permitting the aircraft to take-off.

Correspondingly the clearance area could be the airport terminal, any other parking area for the aircraft, a hall, or the entire airport. In the case of other transport vehicles, the clearance area might be a logistic center (e.g., for trucks), a harbor, a train station, a switching yard station or other parts of the previously listed areas. The alarm signal can be a visible, audible signal or a signal provided by the computer system to a certain security operator of the clearance area. For example, the alarm signal may be send-out by an alarm signal means such as a horn, a loudspeaker, a flashlight or other alarm signal means. The advantage of such a sealing system is the ease and fast logging of the sealing procedure, the availability of the logged data to any person having a need to know, the easy archiving of any sealing procedure, and the improved security for the transport vehicle and the loaded freight by fast and reliable detection of any non-authorized re-opening of a sealed door.

In an embodiment, the clearance system further includes multiple receiving stations arranged at different suitable places within the clearance area to receive the warning signal from any location in the clearance area accessible for transport vehicles. Depending on the range of operation of the sending unit of the seals and the size of the clearance area, multiple receiving stations receive an eventual warning signal from any possible part of the clearance area. The receiving stations may be connected to the computer system via a data connection established by data cables or wireless, applying a data transmission technology with a larger range of operation or by forwarding the received data from one receiving station to the neighbored receiving stations until the transmitted data can be received by the computer system.

The invention further relates to a method for operating a sealing system according to the present invention including the steps of: attaching at least one seal to each door of the transport vehicle; activating the seal via an indicator after attaching the seal to the transport vehicle; and sending out a warning signal by the seal in case of the seal being detached or damaged after activation of the indicator. The step of activating the seal can be executed manually by the operator, automatically by attaching the seal to the door and a corresponding response to the control unit of the indication means or by an external signal provided from a portable logging devices.

In another embodiment, the method further includes the steps of inserting a particular type of the transport vehicles into the portable logging device; inserting the execution of attaching the seal to a certain door into the portable logging device via a data insert unit, e.g., a machine-readable code provided by a identifier of the seal (1); and storing the inserted data in a data unit of the portable logging device.

In another embodiment, the method includes the steps of receiving and storing the data inserted to the portable logging device from the portable device in a computer system, e.g., via a wireless data connection; receiving a warning signal from the seal in case of detached or damaged seal; and providing an alarm signal at least inside a clearance area as a response of the received warning signal. The alarm signal can be a visible, audible signal or a signal provided by the computer system to a certain security operator.

BRIEF DESCRIPTION OF THE DRAWINGS

These and other aspects of the invention will be apparent from and elucidated with reference to the embodiments described hereinafter.

DETAILED DESCRIPTION OF SPECIFIC EMBODIMENTS

Figure 1:
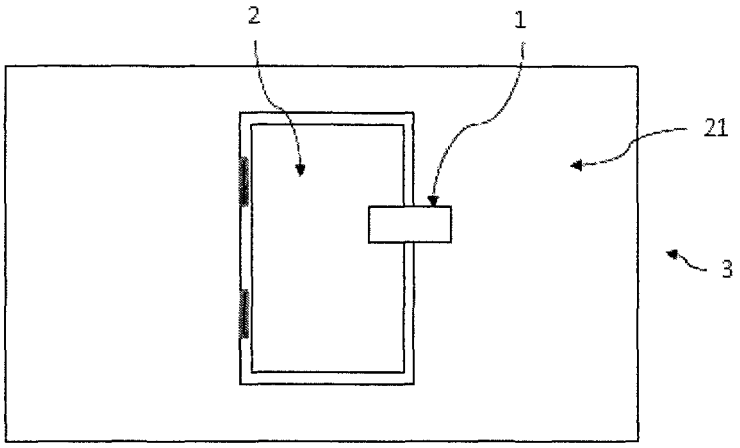
FIG. 1 is a seal according to the present invention on a door of a transport vehicle.

FIG. 1 shows a seal 1 according to the present invention on a door 2 of a transport vehicle 3. One part of the seal 1 (a first area 11 not shown in detail in this figure) is attached to the surface of the door 2, while another part of the seal 1 (a second area 12 not shown in detail in this figure) is attached to the area 21 around the door, here the wall of the transport vehicle 3. The transport vehicle 3 is only indicated schematically. The transport vehicle 3 could be e.g. a truck, a car, a train wagon, a ship, a container for container trucks, an aircraft such as an airplane or a helicopter.

Figure 2:
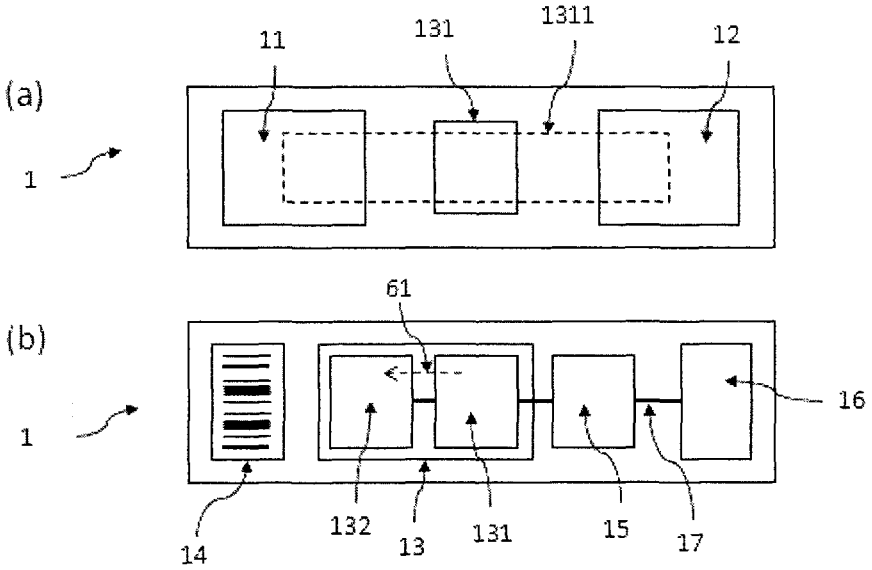
FIG. 2 is one embodiment of a seal according to the present invention shown (a) from the backside and (b) from the front side.

FIG. 2 shows an embodiment of a seal 1 according to the present invention (a) from the backside and (b) from the front side. The backside denotes the side of the seal 1, which is attached to the surface of the door 2 and the area 21 around the door. The front side is the side of the seal 1 facing away from the door 2 and the area around the door 21. The backside of the seal 1 comprises a first area 11 (grey) to be attached to the surface of the door and a second area 12 (grey) to be attached to the area around the door. In this embodiment the first and second areas 11, 12 have an adhesive surface to fix the seal 1 on top of door 2 and area around the door 21. A seal 1 with parts 11, 12 on its backside being adhesive can be applied to any doors 2 and areas 21 around the doors regardless of the material of the doors 2 and the areas 21 around the doors. In alternative embodiment, also the area between the first and second areas 11, 12 might be adhesive as well to improve the adhesiveness of the seal 1. In other embodiments, the first and second areas 11, 12 as shown in FIG. 2 might be magnetic areas, which can be fixed to doors 2 and areas 21 around doors made of metal. For different embodiments, the size of the first and second areas 11, 12 might vary. The seal 1 of FIG. 2 has a tape-like shape with a rectangular area and with a thickness small against the other dimensions of the seal 1 (an essentially two-dimensional shape). In other embodiments, the seal 1 might be shaped differently within the scope of this invention, e.g. with circular or oval shape or with a three-dimensional shape, e.g. like a bulky device.

The seal 1 shown in FIG. 2 includes an indicator 13, which includes a control 131 and a sender 132. The control periodically determines a parameter, whose value is characteristic for the status of the door (closed or open). In case of a closed door, the seal is undamaged. The characteristic parameter could be for example the resistance of a wire 1311 present at the surface of the backside of the seal 1. In case of a re-opened door 2 with formally applied seal 1, the seal and in particular the wire 1311 is damaged or broken. The control 131 detects an increase of the resistance along the wire 1311, which correlates to a detached and/or damaged seal 1 as the result of the re-opening of the door 2. In other embodiments the parameter to be detected could be the capacity of a conductive area 1311, which changes, if the seal is damaged or broken. Alternatively, the first and second areas 11, 12 might comprise contact pins of a circuit, which is closed via the surface of the door 2 and/or the surface of the area 21 around the door in case of electrically conductive surfaces. Here, the value of the current through the circuit or the value of the resistance can be utilized to check the status of the door 2 In embodiments, the control means 131 subsequently provides a detection signal 61 (indicated by the dashed arrow in part (b)), an electronic signal 61, to the sender 132. In response of the received detection signal 61, the sender transmits a warning signal 62, that a seal is damaged or broken. The warning signal 62 is received by the sealing system, and processed in order to trigger an inspection of the transport vehicle 3, where the seal 1 is attached. To be able to localize the broken seal 1, each seal 1 carries an identifier 14, with a code being unique for each seal. Preferably the code is machine-readable in order to simplify the assignment of the seal to a code.

The seal may also include a power source 16, e.g. a battery, to operate the control 131 and the sender 132, if these means use a power supply for being operational, e.g. an active RFID. An indicator providing the same functionality could also be passive RFID chips receiving the required energy from the electromagnetic fields present in the environment. The components of the indicator 13 are electrically connected to each other as well as to the battery 16 if present as indicated by the horizontal black line 17. The seal 1 might include a lighting unit 15 to emit light either when being activated or in case of being damaged or detached. If the seal 1 emits light when activated, a simple visual check looking for light emitting seals 1 from a larger distance proves the status of the doors 2. In another embodiment the identification means 14 might be also integrated into the indication means 13, e.g. RFID identification.

Figure 3:
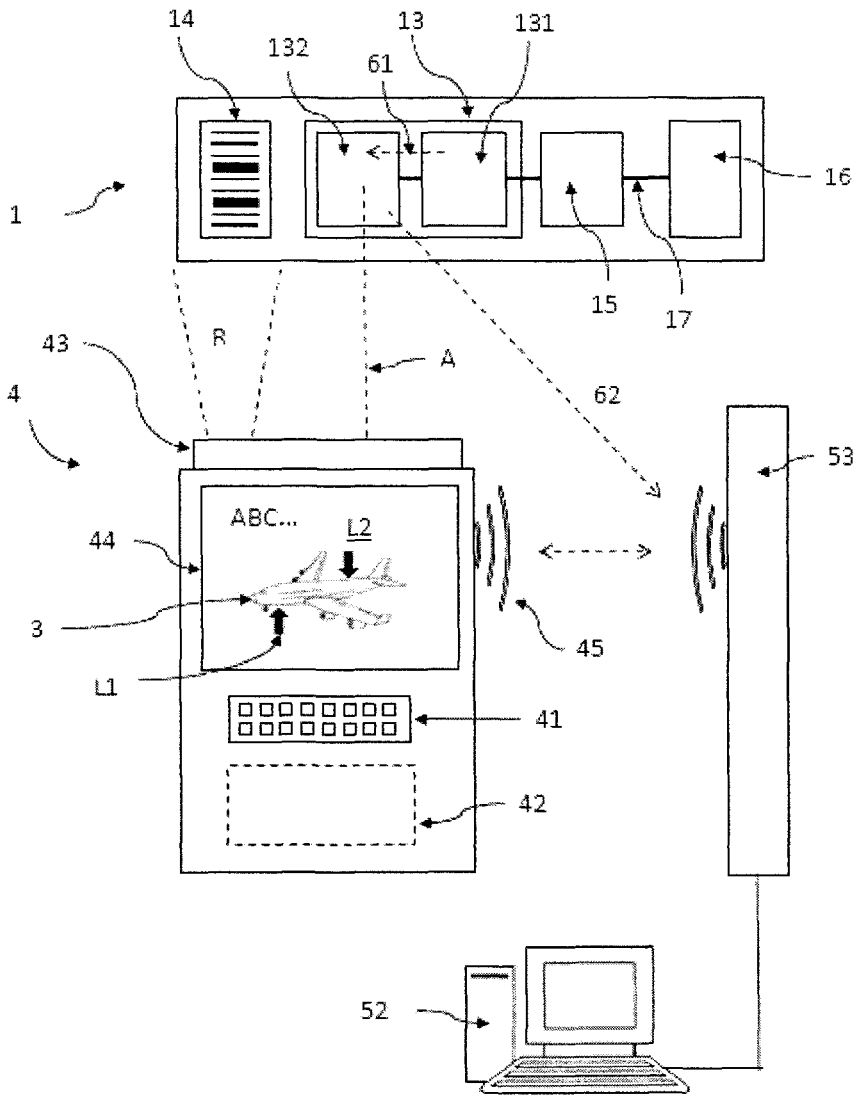
FIG. 3 shows embodiments of a seal and a portable logging device connected to a receiving station and a computer system.

FIG. 3 shows a portable logging device 4, e.g. shape as a hand-held scanner, to record the sealing of doors 2. The portable logging device 4 includes a data insert unit 41 to insert a particular type of the transport vehicles 3 (here displayed as "ABC . . . " in the display unit 44) and to insert the executed attachment of a seal 1 as well as a data unit 42 to store the inserted data. For example, the data unit 42 could be a storage chip or a storage card permanently or reversible mounted to the portable device 4. The data insert unit 41 could be any suitable array of buttons or keys suitable to insert the required data. Here the data insert unit 41 is a small key board. The portable logging device 4 further comprises a display unit 44 to display the location of the doors 2 to be sealed with seals 1. As an example, an aircraft is displayed as the transport vehicle 3, where the two doors (in this particular example) are indicated with bold arrows L1, L2 to support the operator executing the sealing procedure, where the seals 1 have to be attached. After attaching a seal 1 to a door 2 at a location L1, the portable logging device 4 reads R the machine-readable code of the identification means 14 of the particular seal 1 with a reading unit 43 and stores the machine-readable code in the data unit 42. The code of the seal is now correlated to the particular door (location L1 as an example), where the seal is attached. The correlated data of seal and location improves the inspection procedure in case of re-opened doors and also improves the logging of the sealing procedure and simplifies the archiving of the data of each sealing procedure. The portable logging device 4 also includes a data connection unit 45 to transfer the data (identification code of the seal correlated to a certain location of the door, type of the transport vehicle and optional administrative data such as attaching time etc.) to a computer system 52. The data connection further allows to up-date the data stored in the data unit 42. The data connection 45 may be a wireless data connection, where the data are received by receiver 53 and transmitted to the computer system 52 by another data connection, e.g. a data cable. Alternatively, the data connection could be a data port unit able to be inserted in a corresponding plug-in unit to connect the portable logging device 4 to the computer system 52. In other embodiments, it could be possible to activate A the seal 1 with the portable logging device sending out an activation signal A as indicated by the dashed line. The same or other receiving stations 53 are used for establishing the data connection to the portable logging device 4 can be used to receive the warning signal 62 from the seal 1 in case of a re-opened door 2.

Figure 4:
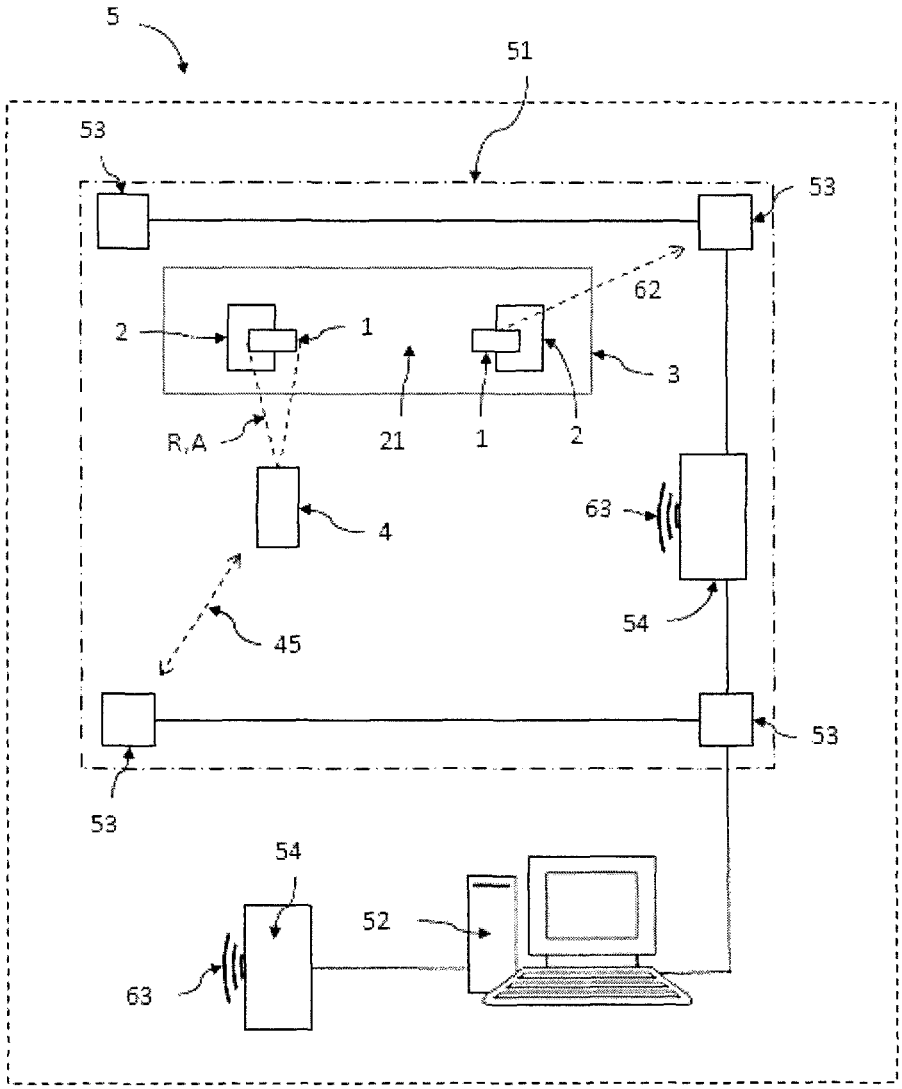
FIG. 4 is a sealing system according to the present invention.

FIG. 4 shows an embodiment of a sealing system according to the present invention. Here, the schematically indicated transport vehicle 3 comprises two doors 2, both equipped with attached seals 1. The portable logging device 4 is used to read R the machine readable code provided by the identification means of the seal 1 and to activate A the indication means of the seal 1 in order to start controlling the status of the door 2. The transport vehicle 3 is located in a clearance area 51 as part of the clearance system 5 further comprising four receiving stations 53 to receive the data transmitted from the portable device 4 in order to record the sealing procedure and to receive a warning signal 62 in case of a damaged or detached seal 1 from any location inside the clearance area 51. The data and/or the warning signal 62 are transmitted from the receiving station 53 to the connected computer system 52, where the sealing data are archived. The sealing data can be re-checked in case of doubts for any performed sealing procedure. The check proves the accurate execution of the sealing procedure without the necessity to repeat the sealing procedure manually saving clearance time. In case of a received warning signal 62, the computer system 52 provides an alarm signal 63 via an alarm signal means 54 (loudspeakers etc.) at least inside the clearance area 51, preferably also to operators located outside the clearance area 51.

Figure 5:
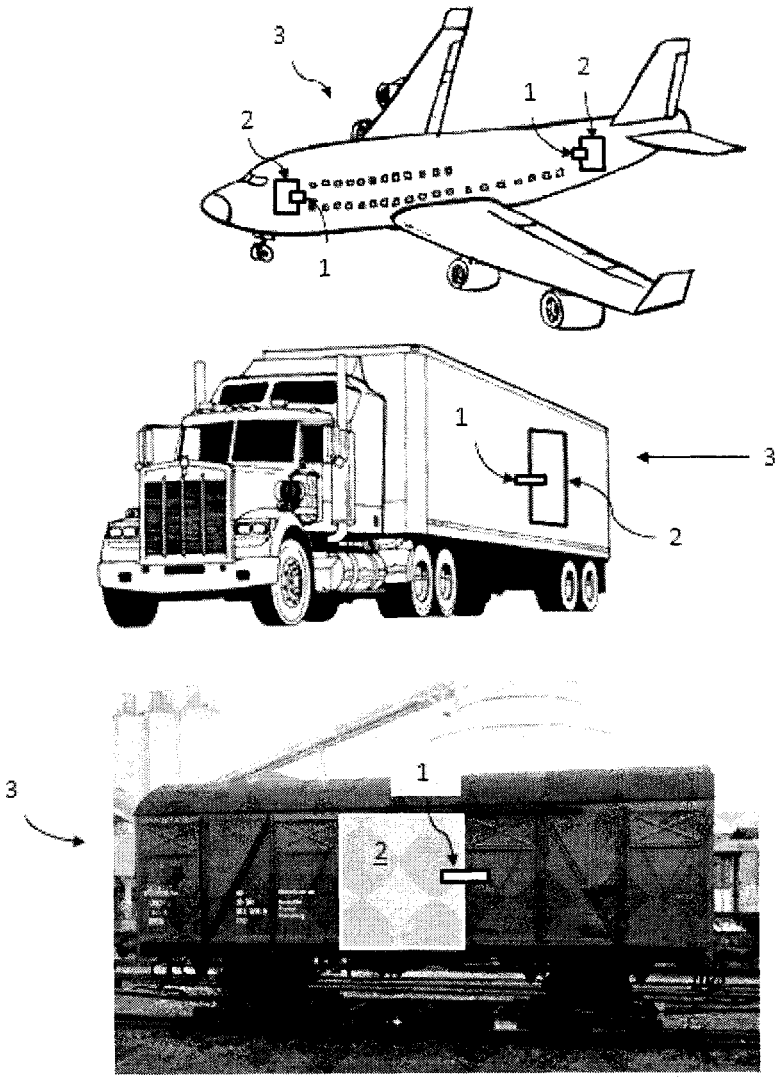
FIG. 5 shows different transport vehicles with attached seals according to the present invention.

FIG. 5 shows three examples of transport vehicles 3, where the sealing system, the seal and the portable logging device can be applied to, e.g. an airplane, a truck, or a train wagon. The application of the seal, the portable device, the sealing system and the sealing method to other transport vehicles 3 is also covered by the subject innovation.

While the invention has been illustrated and described in details in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference sign in the claims should not be construed as limiting the scope.

The invention claimed is:

1. A seal having a tape-like shape, for sealing of doors of a transport vehicle, attachable to the doors to indicate closure of a door, the seal comprising a first area to be positioned onto the door and a second area to be positioned onto an area around the door, wherein the seal further comprises an indicator further comprising a controller to detect a detaching or damaging of the seal by breaking of a closed electrical circuit in case of re-opening the door and being suitable to send out a warning signal in case of a detached or damaged seal after activation of the indicator, wherein the indicator is suitable to be activated by an activation signal sent out by a portable logging device comprising a data insert unit inserting a particular type of the transport vehicle and to insert an executed attachment of a seal to a certain door to record a sealing of the door, a data unit storing inserted data, and the portable logging device sending out an activation signal to the seal after attaching the seal to the transport vehicle, wherein the first and second areas each comprise two contact pins, where the two contact pins of the first area are arranged to establish an electrical contact between each other via a conductive surface of the door and the two contact pins of the second area are arranged to establish an electrical contact between each other via a conductive surface of the area around the door in order to provide the closed electrical circuit by attaching the seal to the door and the area around the door.

2. The seal of claim 1, wherein the first area and the second area are arranged to apply an adhesive and/or magnetic force to the door and the area around the door in order to be attached.

3. The seal of claim 1, wherein the seal further comprises an identifier providing a machine-readable code suitable to be read by the portable logging device after attaching the seal at least to the door.

4. The seal of claim 1, wherein the indicator comprises a control to detect a detaching or damaging of the seal and to subsequently provide a detection signal, which is an electronic signal.

5. The seal of claim 4, wherein the indicator comprises a sender, suitable to send out the warning signal as a response to the detection signal provided by the control.

6. The seal of claim 1, wherein the seal further comprises a lighting unit emitting light after activation.

7. The seal of claim 1, wherein the transport vehicle is an aircraft.

8. A portable logging device for sealing of doors of transport vehicles comprising a data insert unit inserting a particular type of the transport vehicles and to insert the executed attachment of a seal to a certain door to record a sealing of the door, a data unit storing inserted data, and the portable logging device sending out an activation signal to the seal, wherein the seal having a tape-like shape, for sealing of doors of a transport vehicle, which is an aircraft, attachable to the doors to indicate closure of a door comprising a first area to be positioned onto the door and a second area to be positioned onto an area around the door, wherein the seal further comprises an indicator suitable to be activated by the activation signal to send out by the portable logging device after attaching the seal to the transport vehicle and suitable to send-out a warning signal in case of a detached or damaged seal after activation of the seal, wherein the portable logging device further comprises a display unit displaying a location of the door to be sealed with seals of the particular type of the transport vehicle inserted into the data insert unit, and wherein the first and second areas each comprise two contact pins, where the two contact pins of the first area are arranged to establish an electrical contact between each other via a conductive surface of the door and the two contact pins of the second area are arranged to establish an electrical contact between each other via a conductive surface of the area around the door in order to provide the closed electrical circuit by attaching the seal to the door and the area around the door.

9. The portable logging device of claim 8, wherein the seal comprises an identifier providing a machine-readable code and the portable logging device further comprises a reading unit reading the machine-readable code and the data unit stores the machine-readable code.

10. The portable logging device of claim 9, wherein the portable logging device further comprises a display unit displaying a location of each door of the particular type of the transport vehicles, wherein the seal is attached, and correlates a location of a door with the machine-readable code of the identifier of the seal attached to this door.

11. The portable logging device of claim 10, wherein the portable logging device comprises a data connection unit transferring stored data to a computer system and/or update data stored in the data unit, via a wireless data connection.

12. A sealing system for sealing of doors of transport vehicles comprising:

multiple seals having a tape-like shape, for sealing of doors of a transport vehicle, attachable to the doors to indicate closure of a door comprising a first area to be positioned onto the door and a second area to be positioned onto an area around the door, wherein the seals further comprise an indicator further comprising a controller to detect a detaching or damaging of the seal by breaking of a closed electrical circuit in case of re-opening the sealed door, wherein the indicator is suitable to send out a warning signal in case of a detached or damaged seal after activation of the indicator and to be activated by an activation signal send out by a portable logging device suitable to be activated after attaching the seal to the transport vehicle and suitable to send-out a warning signal in case of a detached or damaged seal after activation of the indicator, wherein the first and second areas each comprise two contact pins, where the two contact pins of the first area are arranged to establish an electrical contact between each other via a conductive surface of the door and the two contact pins of the second area are arranged to establish an electrical contact between each other via a conductive surface of the area around the door in order to provide the closed electrical circuit by attaching the seal to the door and the area around the door;

the portable logging device for sealing of doors of transport vehicles comprising a data insert unit inserting a particular type of the transport vehicles and to insert the executed attachment of one of the multiple seals to a certain door to record a sealing of the door, and a data unit storing inserted data, wherein the portable logging device sends out the activation signal to the seal; and a clearance system comprising a computer system for receiving and storing data from the portable logging device, suitable to receive the warning signal from the seal and to provide an alarm signal at least inside a clearance area as a response of the received warning signal.

13. The sealing system of claim 12, wherein the clearance system further comprises multiple receiving stations arranged at different suitable places within the clearance area to receive the warning signal from any location in the clearance area accessible for transport vehicles.

14. The sealing system of claim 12, wherein the transport vehicle is an aircraft.

15. A method for operating a sealing system, comprising:

attaching at least one seal having a tape like shape to each door of a transport vehicle, the seal comprising a first area positioned onto the door and a second area positioned onto an area around the door, wherein the seal further comprises an indicator further comprising a controller to detect a detaching or damaging of the seal by breaking of a closed electrical circuit in case of re-opening the sealed door, wherein the first and second areas each comprise two contact pins, where the two contact pins of the first area establish an electrical contact between each other via a conductive surface of the door and the two contact pins of the second area establish an electrical contact between each other via a conductive surface of the area around the door providing the closed electrical circuit by attaching the seal to the door and the area around the door;

activating an attached seal via the indicator by an activation signal send out by a portable logging device comprising a data insert unit inserting a particular type of the transport vehicles and to insert an executed attachment of a seal to a certain door to record a sealing of the door, a data insert unit storing inserted data, and the portable logging device sending out an activation signal to the seal after attaching the attached seal to the transport vehicle; and sending out a warning signal by the attached seal in case of the attached seal being detached or damaged after activation of the indicator.

16. The method of claim 15, further comprising:

inserting a particular type of the transport vehicle into the portable logging device via the data insert unit, inserting an execution of attaching the attached seal to a certain door into the portable logging device via the data insert unit by reading a machine-readable code provided by an identifier of the attached seal; and storing the inserted data in the data unit of the portable logging device.

17. The method of claim 16, further comprising:

receiving and storing data inserted to the portable logging device from the portable device in a computer system via a wireless data connection;

receiving a warning signal from the attached seal in case of a detached seal or a damaged seal; and providing an alarm signal at least inside a clearance area in response to receiving the warning signal.

18. The method of claim 15, wherein the transport vehicle is an aircraft.

* * * * *